US006076682A

United States Patent [19]

Gustafsson et al.

[11] Patent Number: 6,076,682

[45] Date of Patent: Jun. 20, 2000

[54] PROCESS FOR FROTH FLOTATION OF SILICATE-CONTAINING IRON ORE

[75] Inventors: Jan Olof Gustafsson, Kungälv; Anders Klingberg, Henån, both of Sweden

[73] Assignee: Akzo Nobel N.V., Arnhem, Netherlands

[21] Appl. No.: 09/199,372

[22] Filed: Nov. 25, 1998

[30] Foreign Application Priority Data

Nov. 27, 1997 [SE] Sweden ..... 9704365

[51] Int. Cl.[7] ..... B03D 1/02; B03D 1/01

[52] U.S. Cl. ..... 209/166; 252/61; 209/167

[58] Field of Search ..... 209/166, 167; 252/61

[56] References Cited

U.S. PATENT DOCUMENTS

| | | | |
|---|---|---|---|
| 3,363,758 | 1/1968 | Cronberg . | |
| 4,168,227 | 9/1979 | Polgaire et al. . | |
| 4,319,987 | 3/1982 | Shaw et al. . | |
| 4,472,270 | 9/1984 | Agrawal . | |
| 4,732,667 | 3/1988 | Hellsten et al. . | |
| 4,830,739 | 5/1989 | Hellsten et al. | 209/166 |
| 5,182,039 | 1/1993 | Miller et al. | 252/61 |
| 5,540,336 | 7/1996 | Schreck et al. | 209/166 |
| 5,540,337 | 7/1996 | Riggs et al. | 209/166 |

FOREIGN PATENT DOCUMENTS

| | | |
|---|---|---|
| 1100239 | 4/1981 | Canada . |
| 2205885 | 12/1997 | Canada . |

OTHER PUBLICATIONS

*Derwent Abstract*, AU2364797, dated Dec. 11, 1997.

*Derwent Abstract*, AU2364897, dated Dec. 11, 1997.

*Primary Examiner*—Thomas M. Lithgow

*Attorney, Agent, or Firm*—Ralph J. Mancini; Lainie E. Parker

[57] ABSTRACT

The present invention relates to a process for enriching an iron mineral from a silicate-containing iron ore by carrying out, at a pH of 8–11, a froth flotation in the presence of a depressing agent for the iron mineral and a collecting agent containing a combination of an ether monoamine and an ether polyamine, which contain an aliphatic hydrocarbon group having 6–22 carbon atoms in a weight ratio of the ether monoamine to the ether polyamine of 1:4–4:1. The invention also discloses a composition which is suitable for use in the process.

8 Claims, No Drawings

PROCESS FOR FROTH FLOTATION OF SILICATE-CONTAINING IRON ORE

FIELD OF THE INVENTION

The present invention relates to a process for froth flotation of silicate-containing iron ore by using a collecting agent which contains a combination of an ether monoamine and an ether polyamine.

BACKGROUND OF THE INVENTION

Iron ore frequently contains a considerable amount of silicate. The presence of silicate has been found to have a negative effect on the quality of the iron and complicates the process for the production of iron. It is therefore essential that the silicate content of the enriched iron mineral can be reduced to a considerable extent, for instance, to a level below 1% by weight.

A frequent method of reducing the silicate content is to carry out inverted froth flotation, the silicate being enriched in the flotate and the iron ore in the bottom fraction. Such froth flotations are disclosed in, inter alia, U.S. Pat. No. 4,732,667, which suggests removal of silicate from iron ore by carrying out froth flotation by using a collecting agent, which contains a primary amine, for instance, an ether amine, in combination with a nitrogen-containing compound which also has an anionic group.

Patent Specification WO 93/06935 discloses the use of at least one ether amine in combination with at least one anionic compound or collecting agent, in froth flotation of silicate-containing iron ore.

Other examples of froth flotation of silicate-containing iron ores are described in U.S. Pat. Nos. 4,319,987 and 4,168,227, in which ether monoamines and mixtures of an ether amine and an amino-1-alkane are used as collecting agents.

CA 1 100 239 discloses the use of monoamines or diamines dispersed with an emulsifying agent as a collector in froth flotation without causing a considerable corrosion of apparatus utilized in the process. A general tendency when applying these froth flotation processes is that the enriched iron mineral has a low silicate content combined with a low iron yield, or a high iron yield and a comparatively high silicate content.

The aim of the present invention is to develop a froth flotation process which results in a high yield of the iron mineral as well as a low silicate content, i.e. develop a more selective flotation process.

SUMMARY OF THE INVENTION

The present invention generally relates to a process for enriching an iron mineral from a silicate-containing iron ore by carrying out, at a pH of 8–11, a froth flotation in the presence of a collecting agent containing an ether amine, and a depressing agent for the iron mineral. The collecting agent contains a combination of at least one primary ether monoamine and at least one primary ether polyamine, which contain an aliphatic hydrocarbon group having 6–22 carbon atoms and are present in a weight ratio of the ether monoamine to the ether polyamine of 1:4–4:1.

DETAILED DESCRIPTION OF THE INVENTION

According to the present invention, it has now been found that this can be achieved by carrying out, at a pH of 8–11, preferably 9–11, an inverted froth flotation of a silicate-containing iron ore in the presence of a collecting agent containing an ether amine and a depressing agent for iron mineral, the collecting agent containing a combination of at least one primary ether monoamine and at least one primary ether polyamine, which contain an aliphatic hydrocarbon group having 6–22 carbon atoms, preferably 8–16 carbon atoms, and are present in a weight ratio of ether monoamine to ether polyamine of 1:4–4:1, preferably 1:2–2:1. By using a combination of the ether monoamine and the ether polyamine as collecting agent in froth flotation, it has been found that a surprisingly good selectivity and a high yield of the silicate are obtained in the flotate, while the bottom fraction contains the iron mineral in a high yield and with a low silicate content. The combination of ether amines has synergistic properties compared with the results obtained for each ether amine separately.

It is also possible according to the invention to effect the froth flotation process in the presence of other collecting agents supplementing the combination of ether amines. Thus, conventional collecting agents which contain anionic groups can be used side by side with the present combination of ether amines to reduce the presence of too high phosphate contents in the silicate-containing iron ore. An alternative process is to carry out, after reduction of the silicate content of the iron ore, an additional froth flotation process for removing phosphate.

The ether monoamine is suitably selected among ether monoamines of the formula $$R^1\text{-}(A)_{n1}ORNH_2 \qquad (I)$$

wherein R1 is a hydrocarbon group, preferably an aliphatic group having 6–22, preferably 8–16, carbon atoms, A is an alkyleneoxy group having 2–4 carbon atoms or a 2-hydroxypropylene group, n1 is a number from 0 to 6, preferably 0 to 3, and R is a group —$CH_2CHXCH_2$—, wherein X is hydrogen or a hydroxyl group, preferably hydrogen.

The ether polyamine is suitably selected among ether polyamines of the formula $$R^2\text{-}(B)_{n2}OR^3NH\text{-}(R^4NH)_mH \qquad (II)$$

wherein $R^2$ is a hydrocarbon group, preferably an aliphatic group having 6–22, preferably 8–16, carbon atoms, B is an alkyleneoxy group having 2–4 carbon atoms or a 2-hydroxypropylene group, n2 is a number from 0 to 6, preferably 0 to 3, $R^3$ is a group —$CH_2CHXCH_2$—, wherein X is hydrogen or a hydroxyl group, $R^4$ designates a group —$C_3H_6$— or —$C_2H_4$—, preferably the group —$C_3H_6$—, and m is a number 1–3, preferably 1.

Particularly preferred ether monoamines and ether polyamines are such amine compounds as of the formula $$R^1OC_3H_6NH_2 \qquad (Ia)$$

wherein $R^1$ is a straight or branched alkyl group having 8–12 carbon atoms, or of the formula $$R^2OC_3H_6NHC_3H_6NH_2 \qquad (IIa)$$

wherein $R^2$ is a straight or branched alkyl group having 8–14 carbon atoms. The compounds of the formulae Ia and IIa have good flotation properties, such as high selectivity and well-balanced frothing, and are also easy to prepare.

The present invention also relates to a composition comprising an ether monoamine and an ether polyamine, which contain an aliphatic hydrocarbon group having 6–22, preferably 8–16, carbon atoms in a weight ratio of the ether monoamine to the ether polyamine of 1:4–4:1. Preferably, the amines have such a structure as to be comprised by the formulae I, Ia, II and IIa.

The hydrocarbon groups $R^1$ and $R^2$ can, independently of each other, be aliphatic groups, such as n-hexyl, isohexyl, n-octyl, isooctyl, 2-ethylhexyl, 2-propylheptyl, n-nonyl, isononyl, tert-nonyl, methyl-branched $C_7$ alkyl, methyl-branched $C_{11}$ alkyl and methyl-branched $C_{13}$ alkyl, dodecyl, tetradecyl, hexadecyl, octadecyl, octadecenyl, linoleyl, linolenyl and behenyl or aromatic groups, such as butyl phenyl, octyl phenyl and nonyl phenyl.

Examples of compounds that can be used as the ether monoamine in the inventive flotation process are n-octyl-O-$(CH_2)_3NH_2$, n-decyl-O-$(CH_2)_3NH_2$, n-decyl-O—$CH_2CH(OH)CH_3NH_2$, n-octyl-O$C_2H_4$O-$(CH_2)_3NH_2$, n-decyl-O-$(C_2H_4O)$-$(CH_2)_3NH_2$, 2-ethylhexyl-O-$(CH_2)_3NH_2$, 2-ethylhexyl-O-$(C_3H_6O)$-$(CH_2)_3NH_2$, 2-propytheptyl-O-$(CH_2)_3NH_2$, branched $C_{11}$-alkyl-O-$(C_2H_4O)$-$(CH_2)_3NH_2$ and branched $C_{11}$-alkyl-O—$CH_2CH(OH)CH_2NH_2$.

Examples of suitable ether polyamines are n-decyl-O—$(CH_2)_3NH$-$(CH_2)_3NH_2$, isononyl-O-$(CH_2)_3NH$-$(CH_2)_3NH_2$, methyl-branched $C_{13}$-alkyl-O-$(CH_2)_3NH$—$(CH_2)_3NH_2$, n-dodecyl-O—$CH_2CH(OH)CH_2$—NH—$(CH_2)_3NH_2$, methyl-branched $C_{13}$-alkyl-O—$C_2H_4O$—$(CH_2)_3NH$-$(CH_2)_3NH_2$, methyl-branched $C_{11}$-alkyl-O—$(CH_2)_3NH$-$(CH_2)_3NH_2$, methyl-branched $C_{11}$-alkyl-$OCH_2CH(OH)CH_2NHC_2H_4NH_2$, 2-propylheptyl-$OCH_2CH(OH)CH_2NHC_2H_4NHC_2H_4NH_2$, n-decyl-$OCH_2CHOHCH_2NHC_2H_4NH_2$, and n-dodecyl-O—$C_2H_4O$—$CH_2CHOHCH_2NHC_2H_4NH_2$.

Unneutralised ether amines of the formulae I, Ia, II and IIa are generally relatively difficult to disperse in an aqueous slurry of ore (pulp) without specific measures, such as heating and vigorous stirring. The stability for such slurries is poor. A method of facilitating the dissolving and, thus, accelerating the flotation process is first to prepare an aqueous mixture of the ether amines and neutralise the nitrogen groups of the ether amines to at least 20% with an acid, for instance, a lower organic acid, such as formic acid, acetic acid and propionic acid, or with inorganic acids, such as hydrochloric acid. Complete neutralisation is not necessary since high salt contents may cause precipitation. Besides, in long-term storing, part of the amine salts can be converted into amide compounds. In an aqueous mixture the ether amine compounds are therefore present suitably in partly neutralised form. For example, 20–70, preferably 25–50% of the amine groups are neutralised.

As neutralising agent, use is suitably made of monocarboxylic acid having 1–3 carbon atoms, such as acetic acid. A different method of facilitating the dispersion in the pulp is to increase the solubility of the ether amines by selecting branched and/or unsaturated hydrocarbon groups, introduce polar nonionic groups as oxyalkylene groups and adapt the size of the hydrocarbon groups $R^1$ and $R^2$. Thus, $R^1$ may contain 6–13, preferably 8–11, hydrocarbon groups and $R^2$ 10–18, preferably 11–15, carbon atoms.

In the flotation process according to the invention, the iron ore can be ground, together with water, in a first step to the desired particle size. As a rule, the ore has a particle size between 5 and 200 $\mu$m. The ground ore is then suspended in water, and fine material is deslimed in conventional manner, for instance, by filtration, settling or centrifuging. Then from this ore a water slurry (pulp) is prepared, to which is added a conventional depressing agent, such as a hydrophilic polysaccharide, e.g. starch, such as maize starch activated by treatment with alkali. Other examples of hydrophilic polysaccharides are cellulose esters, such as carboxymethylcellulose and sulphomethylcellulose; cellulose ethers, such as methyl cellulose, hydroxyethylcellulose and ethyl hydroxyethylcellulose; hydrophilic gums, such as gum arabic, gum karaya, gum tragacanth and gum ghatti, alginates; and starch derivatives, such as carboxymethyl starch and phosphate starch. The depressing agent is normally added in an amount of about 10 to about 1000 g per tonne of ore. Besides, alkali is usually added to a pH of 8–11, preferably 9–11. After conditioning of the ore, the ether monoamine and the ether polyamine can be added, preferably partially neutralised, and the mixture is further conditioned for a while before the froth flotation is carried out. If desired, froth-regulating means can be added on a convenient occasion before the froth flotation.

Examples of suitable froth-regulating additives are methylisobutyl carbinol and alcohols having 6–12 carbon atoms which optionally are alkoxylated with ethylene oxide and/or propylene oxide. After completion of the flotation, a silicate-enriched flotate and a bottom fraction rich in iron and poor in silicate are withdrawn.

The non-limiting Examples below further illustrate the present invention.

EXAMPLE 1

Disintegrated iron ore containing 91.8% by weight $Fe_2O_3$ and 6.1% by weight $SiO_2$ was ground to a particle size, such that 58.7% by weight passed through a screen having an aperture of 38 $\mu$m. The ground ore was then suspended in water and fine-grained material was separated by means of a hydrocyclone. The balance which constituted 92.8% of the original amount had the following particle size distribution.

TABLE 1

Screen Analysis

| Screen aperture um | Accumulated weight quantity of ore, % |
|---|---|
| 300 | 99.4 |
| 210 | 98.4 |
| 150 | 95.9 |
| 105 | 90.1 |
| 75 | 79.1 |
| 53 | 64.8 |
| 38 | 51.5 |

Maize starch in a quantity of 647 mg was added to a 60% pulp containing 830 g ore in the form of an alkaline aqueous solution with 1% by weight of starch. Subsequently, the mixture was conditioned for 5 min and the pulp was transferred to a float cell with a volume of 1.4 l, where additional water was added to a volume of barely 1.4 l, resulting in a pulp density of about 40% by weight. The pH of the pulp was set at 10.5 and an ether monoamine and/or an ether diamine was added in a total amount of 36 mg. The ether monoamine had the following formula $NH_2$—$(CH_2)_3$—O—$R^1$, wherein $R^1$ is a straight $C_{8-10}$-alkyl group, while the ether diamine had the structure $NH_2$—$(CH_2)_3$—NH—$CH_2)_3$—O—$R^2$, wherein $R^2$ is a methyl-branched $C_{13}$ alkyl group.

The alkaline pulp with the added amines was conditioned for 1 min, whereupon a froth flotation was carried out at a temperature of about 21–24° C. After completion of the flotation, the bottom concentrate was withdrawn, dried and analysed in respect of total weight yield, $SiO_2$ content and $Fe_2O_3$ content. The following results were obtained.

TABLE 2

| Test | Weight ratio Monoamine/diamine | Total yield % by weight | $SiO_2$ content % by weight | $Fe_2O_3$ yield % by weight |
|---|---|---|---|---|
| 1 | 100/0 | 80.3 | 0.70 | 84.9 |
| 2 | 75/25 | 82.7 | 0.72 | 87.9 |
| 3 | 50/50 | 86.9 | 0.83 | 91.3 |
| 4 | 25/75 | 86.9 | 0.98 | 90.8 |
| 5 | 0/100 | 91.2 | 1.52 | 92.7 |

The results show that when the flotation was carried out in the presence of a mixture of ether monoamine and ether diamine, a higher $Fe_2O_3$ yield and a lower $SiO_2$ content were obtained compared with what may be expected on the basis of the values for flotation with either the ether monoamine or the ether diamine.

EXAMPLE 2

A froth flotation was carried on the same mineral pulp and in the same process conditions as in Example 1, except that the ether monoamine and the ether diamine were completely neutralised with acetic acid. The result is shown in the table below.

TABLE 3

| Test | Weight ratio monoamine/diamine | Total yield % by weight | $SiO_2O_3$ content % by weight | $Fe_2O_3$ yield % by weight |
|---|---|---|---|---|
| 1 | 100/0 | 84.4 | 0.74 | 89.9 |
| 2 | 50/50 | 88.4 | 0.70 | 94.2 |
| 3 | 0/100 | 84.3 | 0.85 | 89.8 |

The results show that a clear synergistic effect is obtained when the ether monoamine and the ether diamine are present in the same parts by weight.

We claim:

1. A process for enriching an iron mineral from a silicate-containing iron ore by carrying out, at a pH of 8–11, a froth flotation in the presence of a silicate collecting agent containing an ether amine, and a depressing agent for the iron mineral, wherein the collecting agent comprises a combination of at least one primary ether monoamine and at least one primary ether polyamine, each of the monoamine and polyamine containing an aliphatic hydrocarbon group having 6–22 carbon atoms and being present in a weight ratio of the ether monoamine to the ether polyamine of 1:4–4:1.

2. The process of claim 1 wherein the ether monoamine is of the formula $$R^1\text{-}(A)_{n1}ORNH_2 \quad (I)$$

wherein $R^1$ is an aliphatic hydrocarbon group having 6–22 carbon atoms, A is an alkyleneoxy group having 2–4 carbon atoms or a 2-hydroxypropylene group, n1 is a number from 0 to 6, and R is a group —$CH_2CHXCH_2$—, wherein X is hydrogen or a hydroxyl group.

3. The process of claim 2 wherein the ether monoamine is of the formula $$R^1OC_3H_6NH_2 \quad (Ia)$$

wherein $R^1$ is a straight or branched alkyl group having 8–12 carbon atoms.

4. The process of claim 1 wherein the ether polyamine is of the formula $$R^2\text{-}(B)_{n2}OR^3NH\text{-}(R^4NH)_mH \quad (II)$$

wherein $R^2$ is an aliphatic hydrocarbon group having 6–22 carbon atoms, B is an alkyleneoxy group having 2–4 carbon atoms or a 2-hydroxypropylene group, n2 is a number from 0 to 6, $R^3$ is a group —$CH_2CHXCH_2$—, wherein X is hydrogen or a hydroxyl group, $R^4$ designates a group —$C_3H_6$— or —$C_2H_4$— and m is a number 1–3.

5. The process of claim 4 wherein the ether polyamine is of the formula $$R^2OC_3H_6NHC_3H_6NH_2 \quad (IIa)$$

wherein $R^2$ is a straight or branched alkyl group having 8–14 carbon atoms.

6. The process of claim 1 wherein the ether monoamine and the ether polyamine are added to the pulp in the form of an aqueous mixture, where the nitrogen groups of the ether amines are neutralised to at least 20 mole percent with an acid.

7. The process of claim 1 wherein the weight ratio of the ether monoamine to the ether polyamine is 1:2 to 2:1.

8. The process of claim 7 wherein the ether monoamine and the ether polyamine are added to the pulp in the form of an aqueous mixture and neutralised with an acid.

* * * * *